US011406909B2

(12) United States Patent
Zhang

(10) Patent No.: US 11,406,909 B2
(45) Date of Patent: Aug. 9, 2022

(54) MAGNETIC BUILDING BLOCK

(71) Applicant: Huizhou Sunnysolar Technology Co.Ltd, Huizhou (CN)

(72) Inventor: Shungui Zhang, Shenzhen (CN)

( * ) Notice: Subject to any disclaimer, the term of this patent is extended or adjusted under 35 U.S.C. 154(b) by 0 days.

(21) Appl. No.: 17/488,288

(22) Filed: Sep. 28, 2021

(65) Prior Publication Data

US 2022/0016539 A1 Jan. 20, 2022

(30) Foreign Application Priority Data

Jul. 13, 2021 (CN) ..... 202121590534.6

(51) Int. Cl.
*A63H 33/04* (2006.01)
*A63H 33/26* (2006.01)
*A63H 33/06* (2006.01)

(52) U.S. Cl.
CPC ..... *A63H 33/046* (2013.01); *A63H 33/06* (2013.01); *A63H 33/26* (2013.01)

(58) Field of Classification Search
CPC ..... A63H 33/046; A63H 33/06; A63H 33/26
USPC ..... 446/92, 129
See application file for complete search history.

(56) References Cited

U.S. PATENT DOCUMENTS 3,601,921 A * 8/1971 Strohmaier ..... A63H 33/046 446/92
5,746,638 A * 5/1998 Shiraishi ..... A63H 33/046 446/131
6,024,626 A * 2/2000 Mendelsohn ..... A63H 33/046 446/124
7,942,718 B2 * 5/2011 Tenorio ..... A63F 9/1204 446/92
8,850,683 B2 * 10/2014 Haughey ..... A63H 33/046 29/428
9,751,025 B2 * 9/2017 Kiribuchi ..... A63H 33/046
9,873,062 B2 * 1/2018 Purns ..... A63H 33/06
11,103,801 B2 * 8/2021 Vicentelli ..... A63H 33/046
2006/0105666 A1 5/2006 von Oech
2006/0234600 A1 10/2006 Pacheco
2008/0305708 A1 12/2008 Toht
2012/0309259 A1 * 12/2012 Mak ..... A63H 33/046 446/92
2015/0065007 A1 * 3/2015 Klepper ..... A63H 33/046 446/92

(Continued)

*Primary Examiner* — Joseph B Baldori

(57) ABSTRACT

Disclosed is a magnetic building block, including: a bearing body, magnetic bodies, and a retaining body, the bearing body including a sealing member and a bearing member which forms first cavities with the retaining body, the magnetic bodies being located in the first cavities and attracting adjacent external products, to form different shapes; the retaining body is in contact with the magnetic bodies to secure the same. The bearing body, the magnetic bodies, and the retaining body match for use, and the magnetic bodies are relatively fixed in an accommodation cavity through the retaining body and can be magnetically connected to the external products, such that when stacking multiple magnetic building block, different magnetic building blocks can be spliced in different surfaces and further be spliced in a suspension manner, thereby reducing a process of stacking multiple building blocks, providing convenience, and further realizing diversified splicing and meeting users' requirements.

6 Claims, 5 Drawing Sheets

(56) References Cited

U.S. PATENT DOCUMENTS

| | | | | |
|---|---|---|---|---|
| 2015/0258462 | A1* | 9/2015 | Wei | A63H 33/046 446/92 |
| 2015/0262744 | A1* | 9/2015 | Wei | H01F 7/02 335/306 |
| 2018/0056204 | A1* | 3/2018 | Knudsen | A63H 33/046 |
| 2019/0201804 | A1* | 7/2019 | Khalus | A63H 33/046 |
| 2020/0398175 | A1* | 12/2020 | Rosen | H01F 7/02 |
| 2020/0406156 | A1* | 12/2020 | Rosen | A63H 33/046 |
| 2021/0322891 | A1* | 10/2021 | Xu | A63H 33/046 |

* cited by examiner

MAGNETIC BUILDING BLOCK

TECHNICAL FIELD

The utility model relates to the technical field of toys, and in particular, to a magnetic building block.

BACKGROUND ART

A building block is a wooden or plastic cubic toy with a fixed structure. To increase the diversity, building blocks may be decorated with letters or pictures on each surface and can be arranged or stacked in different forms. Building blocks are effective tools in improving children's intelligence through rearranging and restructuring the building blocks into various shape and structures such as houses, bridges, people, animals, or the likes.

Traditional building blocks are stacked by the means of gravity where the structure of the lower tier building blocks lay the foundation for higher tiers. Therefore, if a child builds around an upper tier building block, the lower building blocks are required to be laid first, for young children this can be difficult and frustrating causing a poorer playing experience. Moreover, limiting the shaping arrangement of the stacked building blocks and also limiting the capacity of imagination for children.

SUMMARY

Aiming to elevate the issues prior, the utility model provides a solution using magnetic encased inside the building blocks.

The magnetic building block disclosed by the utility model includes a bearing body, magnetic bodies, and a retaining body. The bearing body is provided with an accommodation cavity, and the magnetic bodies are located in the accommodation cavity and attract external products through wall surfaces of the bearing body. The retaining body is disposed in the accommodation cavity and is in contact with the magnetic bodies to secure the magnetic bodies. The bearing body includes a bearing member and a sealing member, the bearing member is provided with the accommodation cavity, and the sealing member covers the bearing member. The retaining body and wall surfaces of the bearing member form first cavities. The retaining body includes a first retaining frame, which forms four first cavities with the four wall surfaces of the bearing member in a horizontal direction, and the magnetic bodies are located in the first cavities.

In one embodiment, the retaining body further includes retaining members which are arranged on the sealing member, located in the first cavities, and abut against the magnetic bodies, respectively.

In one embodiment, the bearing member is further provided with a connecting groove, the sealing member is provided with a connecting block, and the connecting block matches the connecting groove and is located in the connecting groove.

In one embodiment, the retaining body further includes cover plates which match ports of the first cavities and cover the ports of the first cavities.

In one embodiment, the first retaining frame further forms the first cavity with a bottom wall of the bearing member in a vertical direction, the retaining body further includes a second retaining frame, one end of which is located in the first cavity further formed by the first retaining frame and the bottom wall of the bearing member in the vertical direction.

In one embodiment, the retaining body further includes a third retaining frame, the third retaining frame and the sealing member form a second cavity, and the other end of the second retaining frame is located in the second cavity and abuts against the magnetic body in the second cavity.

In one embodiment, the magnetic bodies are magnets.

The utility model has the beneficial effects: the bearing body, the magnetic bodies, and the retaining body match for use, the bearing body includes the bearing member and the sealing member, the bearing member and the retaining body form first cavities, and the magnetic bodies are relatively fixed in the first cavities by means of the retaining body and can be magnetically connected to the external products through the bearing body, such that when a plurality of magnetic building blocks are stacked, different surfaces of the different magnetic building blocks may be spliced according to requirements, and the different magnetic building blocks can further be spliced in a suspension manner, which not only reduces a process of stacking a large number of building blocks and provides convenience, but also can further realize diversified splicing more comprehensively, thereby meeting requirements of a user.

BRIEF DESCRIPTION OF THE DRAWINGS

The accompanying drawings described herein serve to provide a further understanding of the disclosure and form a part hereof, and the illustrative embodiments of the disclosure and the description of the illustrative embodiments serve to explain the disclosure and are not to be construed as unduly limiting the disclosure. In the accompanying drawings.

DESCRIPTION OF REFERENCE NUMERALS

1-bearing body; 11-accommodation cavity; 12-bearing member; 121-connecting groove; 13-sealing member; 131-connecting block;

2-magnetic body;

3-retaining body; 31-first retaining frame; 32-retaining member; 33-cover plate; 34-second retaining frame; 35-third retaining frame;

4-first cavity; and

5-second cavity.

DETAILED DESCRIPTION OF EMBODIMENTS

A plurality of embodiments of the utility model will be disclosed below with reference to the accompanying drawings, and many practical details will be described in the following description for clarity. However, it should be understood that these practical details should not be used to limit the utility model. That is to say, in some embodiments of the utility model, these practical details are not necessary. In addition, to simplify the accompanying drawings, some conventional structures and components will be shown in the simple schematic diagrams.

In addition, description referring to "first" and "second" in the utility model is only used for description, and does not particularly refer to an order or sequence, nor is it used to limit the utility model. It is only used for distinguishing components or operations described by the same technical term, and cannot be understood as indicating or implying relative importance thereof or implicitly indicating the number of the indicated technical features. Thus, a feature defined with "first", and "second", may explicitly or implicitly include at least one of the features. In addition, the technical solutions of the embodiments may be combined with one another, which must be based on the achievement by those of ordinary skill in the art, and when the combinations of the technical solutions contradict one another or cannot be achieved, it should be considered that the combinations of the technical solutions do not exist and do not fall within the scope of protection claimed in the utility model.

Figure 1:
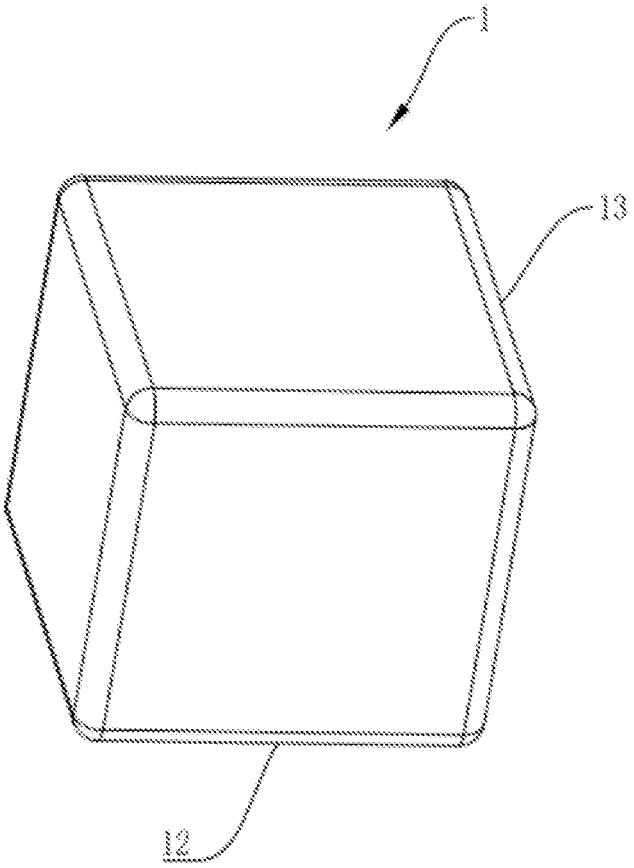
FIG. 1 is a schematic structural diagram of a magnetic building block according to an embodiment.
Figure 2:
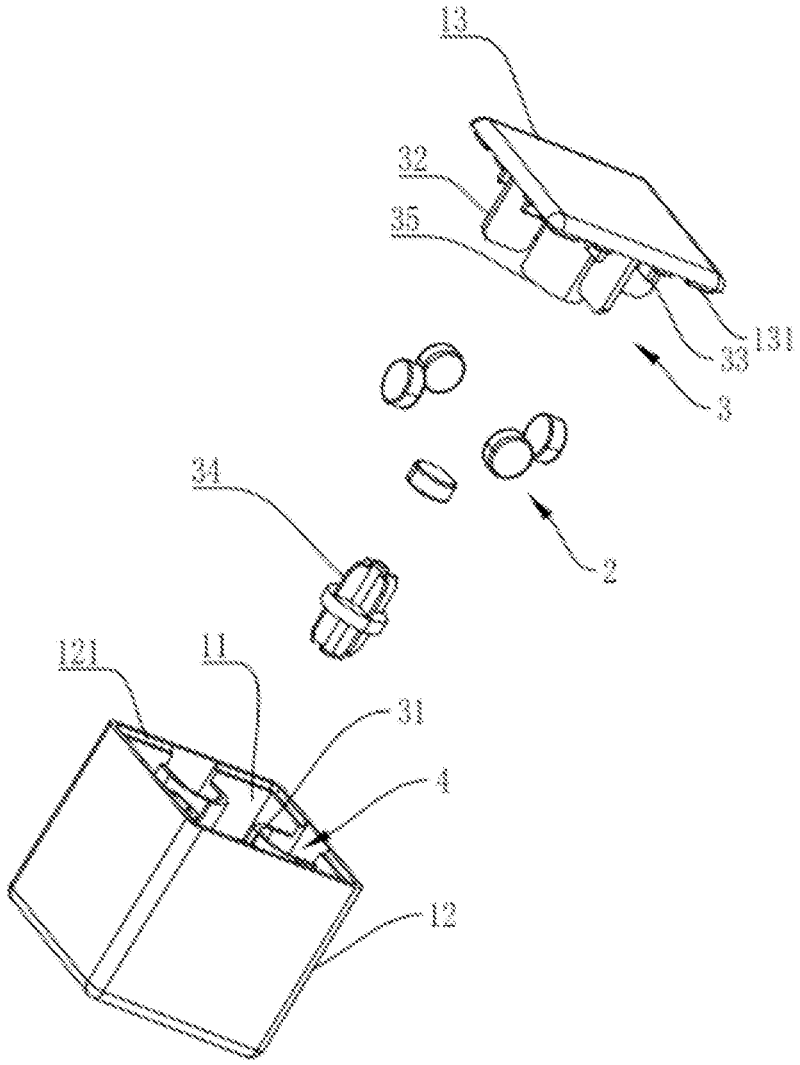
FIG. 2 is an exploded view of the magnetic building block according to an embodiment.

As shown in FIG. 1 and FIG. 2, FIG. 1 is a schematic structural diagram of a magnetic building block in the embodiment, and FIG. 2 is an exploded view of the magnetic building block in the embodiment. The magnetic building block in the embodiment includes a bearing body 1, magnetic bodies 2, and a retaining body 3. The magnetic bodies 2 are disposed inside the bearing body 1, and the retaining body 3 is also disposed inside the bearing body 1 and is in contact with the magnetic bodies 2. The magnetic bodies 2 can be magnetically connected to external products through the bearing body 1, and the retaining body 3 is used to secure the magnetic bodies 2.

Figure 3:
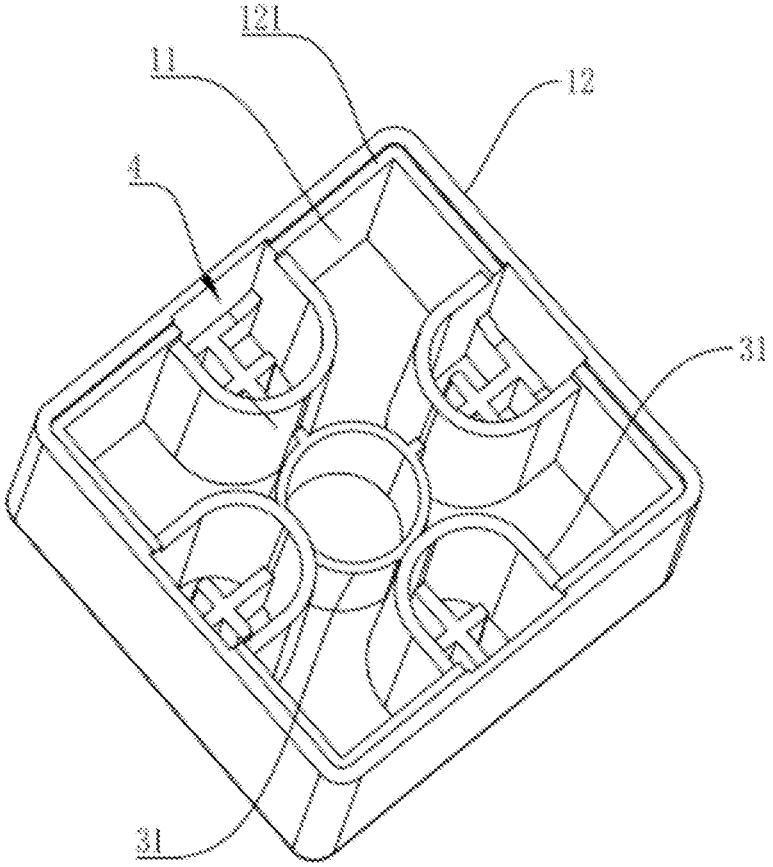
FIG. 3 is a schematic diagram of a stereoscopic structure of a bearing member according to an embodiment.
Figure 4:
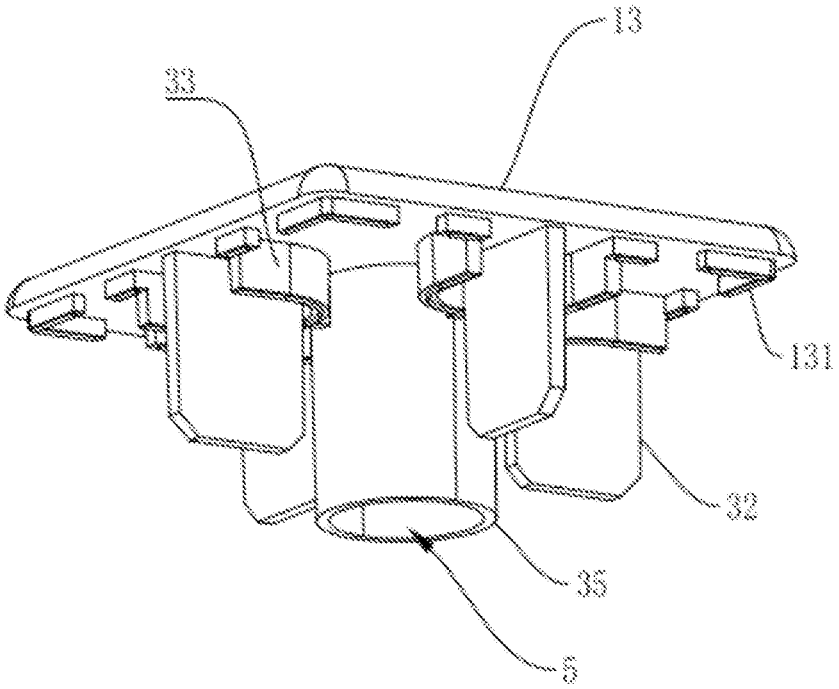
FIG. 4 is a schematic diagram of a stereoscopic structure of a sealing member according to an embodiment.

Further referring to FIG. 3 and FIG. 4 in combination, FIG. 3 is a schematic diagram of a stereoscopic structure of a bearing member 12 in the embodiment, and FIG. 4 is a schematic diagram of a stereoscopic structure of a sealing member 13 in the embodiment. The bearing body 1 includes a bearing member 12 and a sealing member 13, the bearing body 12 is provided with an accommodation cavity 11, the magnetic bodies 2 and the retaining body 3 are all located in the accommodation cavity 11, and the sealing member 13 covers the bearing body 12, such that the accommodation cavity 11 becomes a closed space to prevent an internal component from falling out. Preferably, the bearing member 12 is provided with a connecting groove 121, the sealing member 13 is provided with a connecting block 131, and the connecting block 131 matches the connecting groove 121. When the sealing member 13 covers the bearing member 12, the connecting block 131 is located in the connecting groove 121 and is connected to the connecting groove 121. Further preferably, after the sealing member 13 covers the bearing member 12, glue may be applied to connecting edges of the sealing member 13 and the bearing member 12 to further secure them, and prevent the sealing member 13 from falling off during use.

During specific application, the retaining body 3 includes a first retaining frame 31 disposed in the accommodation cavity 11. In addition, the first retaining frame 31 is connected to an inner surface of the bearing member 12 to form first cavities, and the magnetic bodies 2 are disposed in the first cavities. Specifically, the first retaining frame 31 is connected to wall surfaces of the bearing member 12 in a horizontal direction, to form a plurality of first cavities. In this embodiment, the first retaining frame 31 is connected to the four wall surfaces of the bearing member 12 to form four first cavities, and one magnetic body 2 is placed in each corresponding first cavity. In another embodiment, the retaining body 3 further includes retaining members 32, the retaining members 32 are arranged on one side, facing the accommodation cavity 11, of the sealing member 13, extend into the first cavities from the sealing member 13 and abut against the magnetic bodies 2. Through an arrangement of the retaining members 32, the magnetic bodies 2 in the first cavities are secured, and the problem that the magnetic bodies 2 may not be fixedly and magnetically connected to other products due to position deviation is avoided. Certainly, one retaining member 32 is provided in each corresponding first cavity, such that the number of the retaining members 32 is the same as that of the first cavities and that of the magnetic bodies 2. Preferably, the retaining body 3 further includes cover plates 33, the cover plates 33 and the retaining members 32 are arranged on the same side of the sealing member 13, the cover plates 33 match ports of the first cavities. That is, after the sealing member 13 covers the bearing member 12, the cover plates 33 also cover the ports of the first cavities, such that the magnetic bodies 2 are prevented from falling out of the first cavities during use, and stability of the magnetic building block during use is further enhanced. Similarly, the number of the cover plates 33 corresponds to the number of the first cavities, and each cover plate 33 covers the port of the corresponding first cavity.

Further preferably, the first retaining frame 31 further forms the first cavity with a bottom wall of the bearing member 12 in a vertical direction. To prevent the magnetic body 2 in the first cavity from falling out, the retaining body 3 further includes a second retaining frame 34, one end of which is located in the first cavity and abuts against the magnetic body 2. Further preferably, the retaining body 3 further includes a third retaining frame 35 arranged on one side of the sealing member 13, the third retaining frame 35 and the sealing member 13 forms a second cavity 5, in which the magnetic body 2 is also placed, and the other end of the retaining member 32 is located in the second cavity 5 and abuts against the magnetic body 2 in the second cavity 5.

Figure 5:
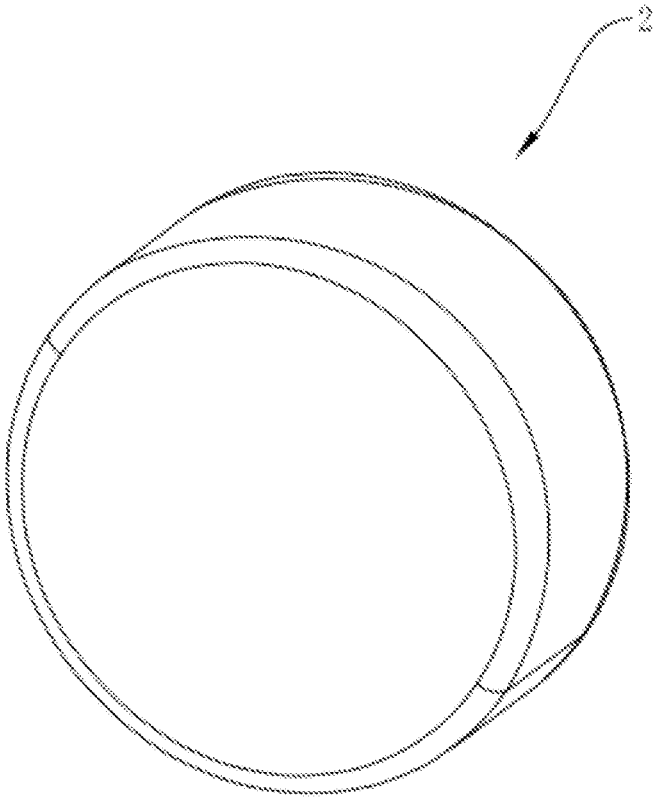
FIG. 5 is a schematic diagram of a stereoscopic structure of a magnetic body according to an embodiment.

Further referring to FIG. 5 in combination, FIG. 5 is a schematic diagram of a stereoscopic structure of the magnetic body 2 in the embodiment. Specifically, the magnetic body 2 is an existing magnet.

The bearing member 12 in this embodiment is of a cuboid structure, one side of which forms an opening of the accommodation cavity 11, and the magnetic bodies 2 are placed in cavities close to the four surfaces in the horizontal direction. The magnetic body 2 in the surface opposite to the sealing member 13 in the vertical direction is secured by the second retaining frame 34, and meanwhile, the magnetic body 2 on the sealing member 13 is also secured by the second retaining frame 34. After the sealing member 13 covers the bearing member 12, the magnetic bodies 2 are placed on all the six surfaces, such that during use, a user may splice any surface according to requirements.

In conclusion, the bearing body, magnetic bodies, and the retaining body match for use, and the magnetic bodies are relatively fixed in an accommodation cavity by means of the retaining body and can be magnetically connected to the external products through the bearing body, such that when a plurality of magnetic building blocks are stacked, the different surfaces of the different magnetic building blocks may be spliced according to requirements, and the different magnetic building blocks may further be spliced in a suspension manner, which not only reduces a process of stacking a large number of building blocks and provides convenience, but also can realize diversified splicing more comprehensively, thereby meeting requirements of a user.

The above description is only the embodiments of the utility model, and is not used to limit the utility model. For those skilled in the art, the utility model may have various modifications and variations. Any modifications, equivalent substitutions, improvements, etc. made within the spirit and principle of the utility model shall all fall within the claims of the utility model.

What is claimed is:

1. A magnetic building block, comprising a bearing body, magnetic bodies, and a retaining body, wherein the bearing body is provided with an accommodation cavity, and the magnetic bodies are located in the accommodation cavity and attract external products through wall surfaces of the bearing body;

the retaining body is disposed in the accommodation cavity and is in contact with the magnetic bodies to secure the magnetic bodies; and the bearing body comprises a bearing member and a sealing member, the bearing member is provided with the accommodation cavity, the sealing member covers the bearing member, and the retaining body and wall surfaces of the bearing member form first cavities, wherein the retaining body comprises a first retaining frame, which forms four first cavities with four wall surfaces of the bearing member in a horizontal direction, and parts of the magnetic bodies are located in the first cavities, the first retaining frame together with a bottom wall of the bearing member in a vertical direction forms a central cavity with a first opening facing the sealing member, through the first opening, one of the magnetic bodies is arranged in the central cavity, and the retaining body further comprises a second retaining frame and a third retaining frame, the third retaining frame and the sealing member form a second cavity with a second opening facing the bearing member, through the second opening, one of the magnetic bodies is arranged in the second cavity, one end of the second retaining frame is located in the central cavity and abuts against the magnetic body in the central cavity, and the other end of the second retaining frame is located in the second cavity and abuts against the magnetic body in the second cavity.

2. The magnetic building block according to claim 1, wherein the retaining body further comprises retaining members, and the retaining members are arranged on the sealing member, located in the first cavities, and abut against the magnetic bodies, respectively.

3. The magnetic building block according to claim 2, wherein the bearing member is further provided with a connecting groove, the sealing member is provided with a connecting block, and the connecting block matches the connecting groove and is located in the connecting groove.

4. The magnetic building block according to claim 3, wherein the retaining body further comprises cover plates which match ports of the first cavities and cover the ports of the first cavities.

5. The magnetic building block according to claim 1, wherein the magnetic bodies are magnets.

6. The magnetic building block according to claim 1, wherein each of the magnetic bodies is in a circular shape, and the central cavity and the second cavity are in a hollow cylinder shape.

* * * * *